US010098393B2

(12) United States Patent
Parker

(10) Patent No.: US 10,098,393 B2
(45) Date of Patent: Oct. 16, 2018

(54) GRIP ASSIST APPARATUS WITH INSERT

(71) Applicant: Power Gripps, USA, Inc., Sorrento, ME (US)

(72) Inventor: Michael S. Parker, Sorrento, ME (US)

( * ) Notice: Subject to any disclaimer, the term of this patent is extended or adjusted under 35 U.S.C. 154(b) by 37 days.

(21) Appl. No.: 15/423,222

(22) Filed: Feb. 2, 2017

(65) Prior Publication Data

US 2018/0213864 A1 Aug. 2, 2018

(51) Int. Cl.
*A41D 19/015* (2006.01)

(52) U.S. Cl.
CPC ..... *A41D 19/01558* (2013.01)

(58) Field of Classification Search
CPC ..... A41D 13/082; A41D 19/01547; A41D 19/01588; A63B 71/141; A63B 2244/09
USPC ..... 2/20, 161.1
See application file for complete search history.

(56) References Cited

U.S. PATENT DOCUMENTS 308,863 A * 12/1884 Worley ..... A41D 19/01547 2/161.8
3,606,319 A * 9/1971 Borden ..... A63D 5/00 2/161.1
4,051,553 A * 10/1977 Howard ..... A63B 71/148 2/161.1
4,417,359 A * 11/1983 Johnson ..... A63B 71/145 2/16
5,018,221 A * 5/1991 Romandetto .... A41D 19/01588 128/878
5,197,149 A * 3/1993 Overton ..... A41D 19/01582 2/161.4
5,350,343 A * 9/1994 DaSilva ..... A41D 13/082 2/20
5,581,809 A * 12/1996 Mah ..... A41D 19/01523 2/161.1
5,815,839 A * 10/1998 Safford ..... A41D 19/015 2/161.1
7,100,212 B2 * 9/2006 Jaeger ..... A41D 19/01558 2/16
8,950,015 B2 * 2/2015 Gibby ..... A41D 13/0156 2/161.1
2002/0155925 A1 * 10/2002 Smith ..... A63B 21/002 482/4
2007/0113317 A1 * 5/2007 Garneau ..... A41D 19/01523 2/161.1
2008/0078010 A1 * 4/2008 Micheloni ..... A63B 71/148 2/160
2009/0288236 A1 * 11/2009 Hawkes ..... A41D 13/018 2/20
2014/0041094 A1 * 2/2014 Leonard ..... A63B 71/141 2/161.1

* cited by examiner

*Primary Examiner* — Sally Haden
(74) *Attorney, Agent, or Firm* — Michael Persson; Catherine Napjus; Lawson Persson & Chisholm PC

(57) ABSTRACT

A grip assist apparatus that may be worn on either hand that includes a gripping portion that includes an insert designed to prevent lifting bars to come into contact with an area of vulnerability in the center of the palm, which is prone to injury.

10 Claims, 14 Drawing Sheets

HUMAN HAND

HUMAN HAND

FIG. 11A
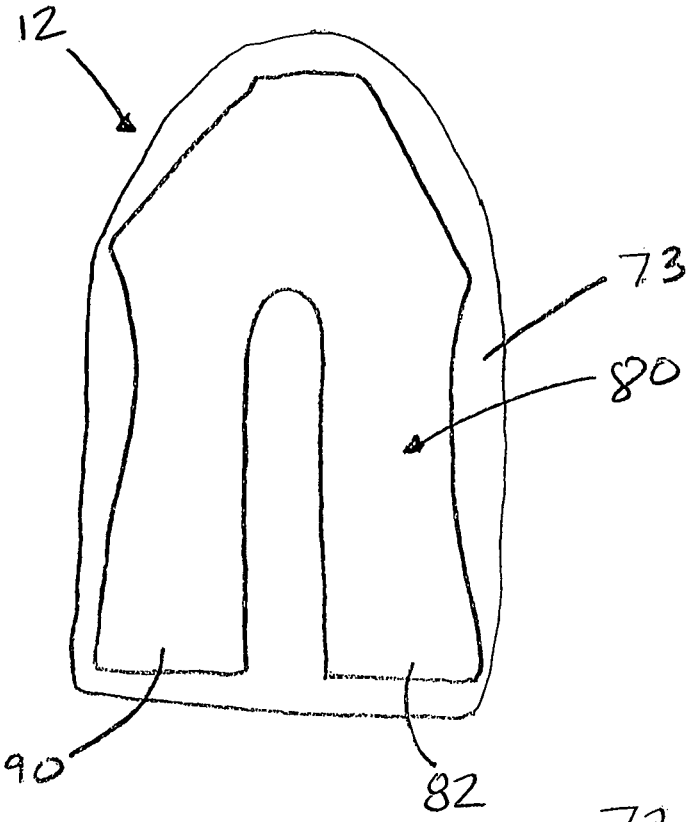
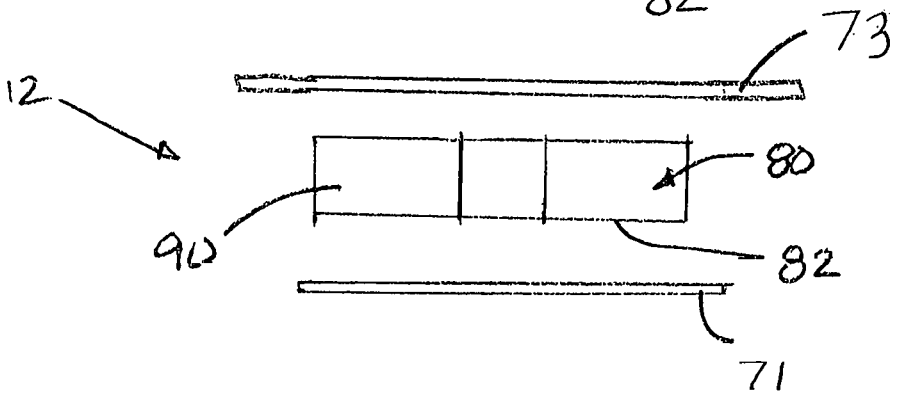
FIG. 11B

GRIP ASSIST APPARATUS WITH INSERT

FIELD OF THE INVENTION

The present invention relates to the field of strength training and weight lifting and, in particular, to grip assist apparatus for use therein.

BACKGROUND

Strength training has become a widely practiced activity for both men and women. In addition to being a sport in and of itself, strength training is also utilized as a conditioning and strengthening exercise for other sports, such as football, basketball, and baseball. Furthermore, athletes who rely on agility, such as tennis players, also benefit from strength training.

In sports, protective equipment is utilized to prevent injury to the participant. With respect to strength training, protective equipment is also needed, as all the joints of the body may be subjected to extreme forces. In particular, the wrist joint is subjected to these extreme forces any time the trainee's hands utilize a weight bar during the course of strength training.

It is also important to protect the palm during weight lifting. This is particularly true during weight lifting exercises when the weight lifter is pushing the weights away from his body, such as with the bench press. FIG. 1 is a skeletal depiction of the hand. The cross hashed bones form the metacarpus consisting of the first 608, second 606, third 604, fourth 602, and fifth 600 metacarpals. The shaded portion near the wrist is the carpus 614. Lines 612, 610 show the rough dimensions of the deep and superficial palmar arches, respectively. The palm of the hand is formed skeletally by the metacarpus consisting of metacarpal bones 600-608. The metacarpus is the intermediate part of the hand skeleton located between phalanges, or bones of the fingers, and the carpus 614 which forms the connection to the forearm. The metacarpals form a transverse arch to which the rigid row of distal carpal bones are fixed. The peripheral metacarpals—those of the thumb 608 and little finger 600—form the sides of the cup of the palmar gutter as they are brought together, they deepen this concavity. The shape of the palm over these bones is formed primarily by the radial and ulnar arteries forming the deep 612 and superficial 610 palmar arches. The superficial palmar arch 610 reaches its apex at about the middle of the metacarpus, while the deep palmar arch 612 reaches its apex about one quarter of the way between the carpus 614 and phalanges, over the metacarpus. The ulnar nerve in particular, as well as the radial and median nerves, are affected by pressure to the palm. Exercises that put a large amount of pressure on these nerves leave the weight lifter susceptible to injury and syndromes, such as carpal tunnel syndrome and Guyon's canal syndrome.

Now referring to FIG. 2, a diagram of a human hand is provided. Overlaid are indications of approximate positions of the thumb fat pad 200, pinky fat pad 202, and metacarpal fat pad series 204. These fat pads are subcutaneous fatty deposits that effectively frame the palm. Thumb fat pad 200 is positioned below the thumb and extends down almost to the wrist. The term "thumb fat pad" as used herein is understood to be so positioned, as illustrated. Metacarpal fat pad series 204 are a series of smaller fat pads roughly covering the tops of metacarpals 600, 602, 604, 606 (as shown in FIG. 1) that together extend across the top of the palm below the fingers. The term "metacarpal fat pad series" as used herein is understood to be so positioned, as illustrated. Pinky fat pad 202 is positioned below the metacarpal fat pad series 204 and the pinky or little finger and, like the thumb fat pad 200, extends down almost to the wrist. The term "pinky fat pad" as used herein is understood to be so positioned, as illustrated. These pads 200, 202, 204 surround dotted area of vulnerability 206. Area of vulnerability 206 does not include fatty deposits, such as pads 200, 202, 204, and is therefore relatively unprotected compared to the rest of the palm. Comparing FIGS. 1 and 2, this area of vulnerability 206 corresponds approximately with the area defined within the lines 610, 612 corresponding to the superficial and deep palmar arches. The term "area of vulnerability" as used herein is understood to be so positioned between pads 200, 202, 204, and roughly corresponding to the area defined within lines 610, 612, as illustrated. It is this relatively unprotected and uncushioned portion of the palm that is most vulnerable to injury during weight lifting, particularly pushing exercises.

U.S. Pat. No. 5,813,950 discloses a grip assist apparatus designed to strengthen the weight lifter's grip and prevent a strength training injury by providing support to the wrist and hand. Although the invention of this patent is successful as a grip assist apparatus, it lacks sufficient palm protection. Moreover, it is designed such that the grip assists are hand specific, which requires the user to determine which grip is to be affixed to which hand and prevents a pair of grips from being used by two people who wish to use them on the same hand.

U.S. Pat. No. 5,771,901 discloses an arch support for a hand that is a plate made to conform to the palm of the hand and has support edges. Although capable of supporting the palm, the invention of this patent does not protect any other part of the hand or wrist that may be affected during strength training, nor does it provide any grip assistance as is preferable during strength training. Moreover, it is hand specific, so one must be purchased for each hand.

U.S. Pat. No. 4,374,439 discloses a bowler's wrist support that includes a flexible body adapted to be wrapped around the hand and wrist straps to hold it in position and a pocket within which fits a pad which is positioned at the palm of the hand. The pad is to fill the space between the palm of the hand and the surface of the ball to provide better contact with the ball to lead to better control. The pad is of foam plastic material which possesses some resilience. The pad is shaped so as to have two relatively straight edges meeting at a rounded corner where the pad is the thickest. This part of the pad fits at the base of the heel of the hand. An arcuate edge of the pad, where it has tapered to its minimum dimension, extends from the end of one of the straight edges and is positioned just below the base of the fingers on the palm of the hand when the wrist support is in use. From the other end of the arcuate edge is a short straight edge that is adjacent the side of the hand, which connects to another straight edge which extends near the base of the thumb. Although capable of aiding in bowling, this invention is ill-suited to provide palm support for weightlifting purposes. Specifically, the pad's flexible nature will adjust with changes in pressure, making changes in grip on a bar difficult. Moreover, as it is contoured to the palm, it is hand specific. In bowling, where most bowlers use only one hand, this is not a problem, but in weightlifting, this would require that the user again determine which grip is used on which hand and prevents a pair from being used by two people.

U.S. Pat. No. 4,546,495 discloses a weightlifting glove apparatus that includes a tapered wedge extending from the heel of the hand inwardly toward the inside palm for use in weightlifting when presses are used. The wedge of this invention is somewhat flexible so that it will curve or bend with the hand as the hand grasps the bar. The wedge includes a generally flat base which extends from the heel of the hand upwardly toward the palm. Extending between opposite ends of the base there is a rounded edge which defines the outer periphery of the wedge. The top or upper portion of the wedge is a generally smoothly continuous concave area. There is a smoothly continuous tapering convex bottom to the wedge which extends from the base outwardly toward a distal end. The distal end is remote from the base. The thickness of the wedge varies from a maximum at the base to a minimum at the distal end. The concave top and the convex bottom are somewhat parallel to each other, although there is a tapering toward each other from the base to the distal end, and both the concave top and the convex bottom taper towards the distal end. Although the wedge of this patent is directed toward weightlifting, it still has drawbacks. Specifically, its flexible nature will adjust with changes in pressure, making changes in grip on a bar difficult. Moreover, as it covers a relatively large area of the hand, and is contoured to the hand, it is hand specific, so one must be purchased for each hand.

There is prior art for devices of the hand that may be worn on either hand. U.S. Pat. No. 6,102,880, for example, discloses a lightweight wrist brace that has a flexible base which extends along the palm and receives a stiffening member within a pocket and is capable of being worn on either a right or a left hand. Although useful for some purposes, this wrist brace would be ill-suited for use in weightlifting. Specifically, it is designed to restrain the movement of the wrist, and the ability to use a full range of wrist motion during weight lifting is preferable. Moreover, it protects only a very small portion of the hand, leaving many areas of the hand that may be affected by weight lifting exposed. Also, as it includes two hand straps that wrap around the hand and are connected to each other across the dorsal area of the hand, it may unduly restrict a gripping motion of the hand, whereas an unfettered grip is extremely important in weightlifting.

U.S. Pat. No. 5,620,399 discloses a gripping sleeve for tightly gripping an object by hand. The gripping sleeve is formed of a plate formed of a tightly gripping or clinging material, the plate being connected to a wrist band by a connecting web. The gripping sleeve can be put on a user's wrist with the wrist band, so that the plate lies in the palm of his or her hand. The plate is, preferably, in the shape of a circle. Although capable of providing grip assistance and to be worn on either hand, this invention has its disadvantages. It provides no additional palm support beyond the plate itself. Only the narrow web covers the base of the hand, leaving much of the base of the hand exposed and prone to irritation and/or injury.

Therefore there is a need for a grip assistance apparatus that may be worn on either hand; that includes a palm protection; that adequately protects the parts of the hand that are affected during weightlifting; and that does not unduly restrict the hand's gripping motion.

SUMMARY OF THE INVENTION

The present invention is a grip assist apparatus for weightlifting that includes an insert that creates a gap that covers the hand's area of vulnerability. The preferred grip assist apparatus of the present invention includes gripping portion that extends from a wrist portion, and a releasable wrist fastener. The inventor's related inventions disclosed in U.S. Pat. No. 5,813,950 and U.S. patent application Ser. No. 12/660,856 are hereby incorporated by reference. One of at least ordinary skill in the art will recognize that some aspects or details discussed in each of these disclosures, but not discussed herein, may be applicable to the present invention.

The preferred grip assist apparatus includes a gripping portion, which covers at least the palm of hand when worn as intended, and a wrist portion attached to the gripping portion. The wrist portion includes straps and fastening means for fastening the wrist portion around the user's wrist, thereby allowing the gripping portion attached thereto to be held against the user's hand. The preferred gripping portion is made of at least two halves or layers. The gripping portion of the preferred grip assist apparatus is preferably made of a single flat piece of material that is folded along a first line of symmetry. It is understood, however, that the gripping portion may be made of two separate pieces of material that are affixed to one another so as to be flush with one another except where one or more inserts may be included between the two halves. The gripping portion of the preferred grip assist apparatus has a finger end at the top, a wrist end opposite from the finger end, attachment edges near the wrist end, for attaching the straps of the wrist portion, and first and second sides between the finger end and the attachment edges.

The gripping portion of the preferred grip assist apparatus also includes an insert between the two halves, where the insert includes a gap. The insert, when placed between the two halves, causes that gripping portion to have three layers everywhere except the gap, where the gripping portion will still have only two layers. The gap is positioned within the insert so that it will cover the area of vulnerability of a user's hand when the user wears the grip assist apparatus. The insert may be of any shape as long as the gap is in a position so that it will be over at least a portion of the area of vulnerability of the user's hand when the grip assist apparatus is worn. This shape may be, for example, a donut shape, either rounded or rectangular as long as the gap in the middle is properly positioned as described above. The insert may also be two inserts in the form of parallel strips with the gap therebetween, the strips being either above and below the area of vulnerability or on either side of the area of vulnerability when the grip assist apparatus is worn. One of at least ordinary skill in the art will recognize that there are many shapes and configurations that the insert may be in order to form a gap over the area of vulnerability.

It is preferred, however, that the insert disposed between the two halves be U-shaped. The U-shaped insert has a first U side near the first side of the gripping portion, a second U side near the second side of the gripping portion, and a connection portion that connects the first and second U sides and is near the wrist end of the gripping portion. Where the U-shaped insert is disposed, the gripping portion has at least three layers—the U-shaped insert and the two halves. Between the first and second U sides is a gap where the gripping portion is only two layers, namely the two halves. The U-shaped insert is positioned within the gripping portion so that when the grip assist apparatus is worn, the U-shaped insert covers at least a portion of the thumb fat pad, the pinky fat pad, and the metacarpal fat pad series. The gap covers the area of vulnerability. The added support of the U-shaped insert will take on additional pressure during lifting so that the area of vulnerability will not come into contact with the lifting bar, thus preventing stress and injury on the area of vulnerability.

In a preferred embodiment, the grip assist apparatus is symmetrical, and therefore wearable on either hand. In this preferred embodiment, each of the halves or layers, which are affixed flush against one another, has a second line of symmetry. It is this second line of symmetry that allows the grip assist apparatus to be wearable on either hand. The first and second sides include mirror image contouring to allow for thumb movability on either side.

It is preferred that the gripping portion be made of non-slip material. It is preferred that an end piece be included at the finger end of the gripping portion of the preferred grip assist apparatus between the two halves of material. It is preferred that the first and second attachment edges of the gripping portion of the preferred grip assist apparatus are angled so that when the first and second straps of the wrist portion are secured about user's wrist via the wrist fastener, the first and second straps and the gripping portion form a funnel-shaped enclosure around the wrist and base of the hand, where the enclosure has an opening that is larger at its distal end than at its proximal end. It is preferred that the first and second straps of the wrist portion be substantially rectangular, "substantially" meaning here that the corners may be rounded, rather than perfect right angles. It is preferred that the means for fastening the straps of the preferred grip assist apparatus around the wrist include a ring on the end of the first strap and sections of hook and loop-type fastener on the second strap, so that the second strap may be threaded through the hook of the first strap and then fastened to itself by way of its hook and loop-type fastener sections. It is preferred that the gripping portion of the preferred grip assist apparatus have rigidity such that it is self-supporting and will remain extended in front of the user's palm and fingers to allow it to be manipulated by the very hand on which it is worn. Moreover, it is preferred that the gripping portion of the preferred grip assist apparatus be sufficiently flexible to allow itself to be easily wrapped around a lifting bar using only the tip of a finger of the hand on which it is being worn. It is preferred that the two halves of material forming the gripping section of the preferred grip assist apparatus be secured by stitching them together. It is also preferred that the stitching help to hold the U-shaped insert in place and define the gap.

In an alternative embodiment of the grip assist apparatus, the gripping portion is integrated into a weightlifting glove. In such embodiments, the wrist portion is eliminated and is replaced by a glove made of a flexible material that is shaped and dimensioned to cover the user's palm and at least a portion of each finger. As with all other embodiments, the gripping portion covers at least the palm of hand when worn as intended and includes two layers of material and an insert disposed these layers.

In some such embodiments, the glove material covering the user's palm forms the first layer of the gripping portion, the insert is positioned upon this layer such that it covers at least a portion of the thumb fat pad, the pinky fat pad, and the metacarpal fat pad series, and is secured to the glove material by a separate layer of material that forms the outer layer of the gripping portion when the grip assist apparatus is worn. However, in other embodiments, the gripping portion includes two separate layers that are secured together with the insert in the desired position therebetween and this gripping portion is secured to the glove material covering the user's palm.

The preferred glove is a weightlifting glove of a half finger design and is made, at least in part, from a breathable material. However, in some embodiments, the glove is of a full finger design that is adapted for work or cold weather use.

These aspects of the present invention are not meant to be exclusive and other features, aspects, and advantages of the present invention will be readily apparent to those of ordinary skill in the art when read in conjunction with the following description and accompanying drawings.

BRIEF DESCRIPTION OF THE DRAWINGS

FIG. 11A is an assembled view of a gripping portion formed by adhering two layers of material together with the insert disposed therebetween.

FIG. 11B is an exploded unassembled view of a gripping portion formed by adhering two layers of material together with the insert disposed therebetween.

DETAILED DESCRIPTION

Figure 3A:
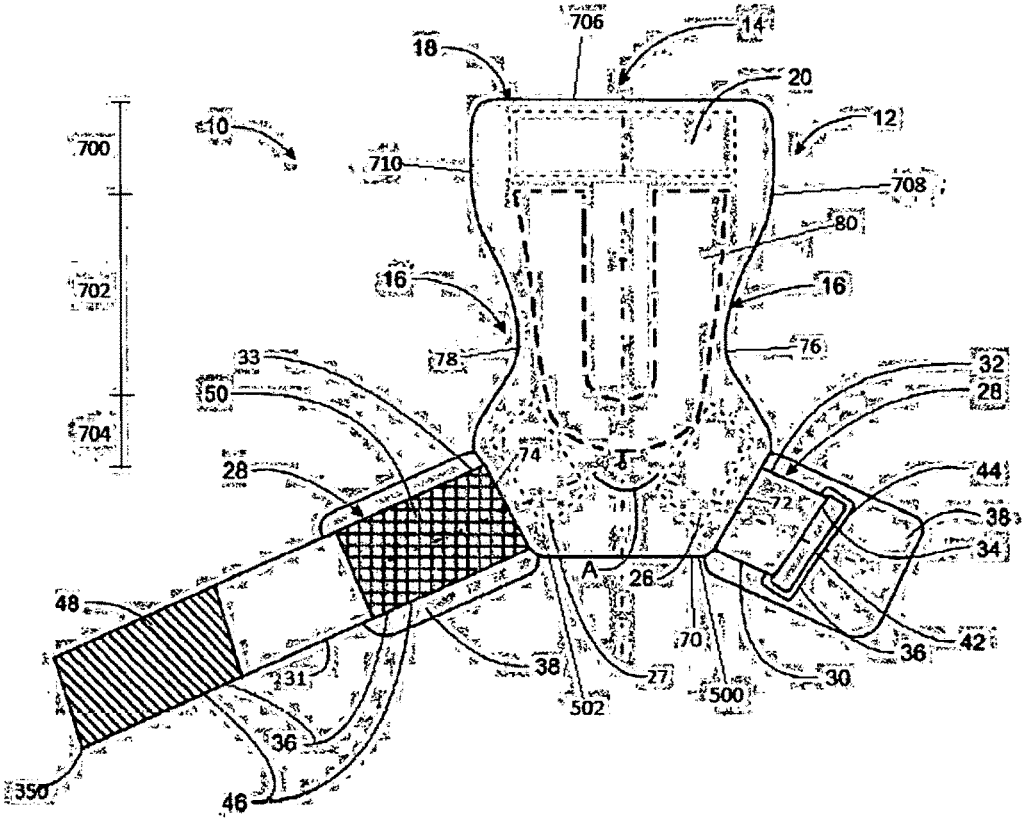
FIG. 3A is a front perspective of the grip assist apparatus of the present invention.

Referring first to FIG. 3A, the preferred grip assist apparatus 10 of the present invention is depicted. The preferred grip assist apparatus 10 includes gripping portion 12, wrist portion 28, and wrist fastener 36. It is understood that the embodiments shown are the preferred embodiments, but not all features shown are necessary for the basic embodiment of the present invention.

Gripping portion 12 is dimensioned to cover a human hand from the fingers to below the wrist joint, without impeding the thumb's movement. Although flexible enough to be easily wrapped around a lifting bar with only the fingers of the hand on which the grip assist apparatus 10 is worn, gripping portion 12 preferably has a rigidity so that it is self-supporting and will remain extended in front of the palm and fingers if not manipulated by the hand on which grip assist apparatus 10 is worn.

In the preferred embodiment of FIG. 3A, gripping portion 12 includes finger end 18, wrist end 70, first attachment edge 72, second attachment edge 74, first side 76, and second side 78. Finger end 18, first side 76, and second side 78 are also labeled as first, second, and third gripping portion edges 706, 708, 710 indicating that these are edges of gripping portion 12, i.e. that gripping portion 12 does not extend further than these edges 706, 708, 710 and is not connected to other structures at these edges 706, 708, 710. Finger end 18 and wrist end 70 are opposite from one another at the top and bottom of gripping portion 12, respectively. Wrist end 70 has first wrist end bearing 500 on its side toward first strap 30 and second wrist end bearing 502 on its other side toward second strap 31. It is understood that first and second wrist end bearings 500, 502 denote either side of wrist end 70. "Bearing" is being used in this context as a synonym for "side," but the inventor, acting as his own lexicographer, has chosen to use "bearing" here so as to avoid confusion with the word "side" used in other contexts herein. First and second attachment edges 72, 74 are disposed adjacent to first and second wrist end bearings 500, 502 of wrist end 70. First and second sides 76, 78 extend between finger end 18 and first and second attachment edges 72, 74. First and second sides 76, 78 each include contouring 16, which accommodate the user's thumb. Contouring 16 results in a narrowing 702 in first and second sides 76, 78; a first widening 700 between narrowing 702 and finger end 18; and a second widening 704 between narrowing 702 and wrist end 70. As will be discussed in more detail below, first and second attachment edges 72, 74 are where first and second straps 30, 31 extend from gripping portion 12.

In embodiments that may be worn on either hand, gripping portion 12 includes second line of symmetry 14. Second line of symmetry 14 is not a structure that would be readily apparent by looking at the gripping portion 12 but, rather, is an imaginary line that runs the length of gripping portion 12. The symmetry of the gripping portion 12 allows the preferred grip assist apparatus 10 to be worn on either hand. Although it is understood that there are at least two symmetries along second line of symmetry 14, including symmetry through the plane of gripping portion 12, it is understood that as used herein, "second line of symmetry" refers only to the symmetry that becomes apparent if one were to fold the gripping portion 12 along the second line of symmetry 14. It is further understood that although "first" features of gripping portion 12 are indicated on the right and "second" features" of gripping portion 12 are indicated on the left, these designations are arbitrary, as gripping portion 12 is symmetrical and all "first" and "second" features of gripping portion 12 are mirror images of the other across second line of symmetry 14.

Figure 3B:
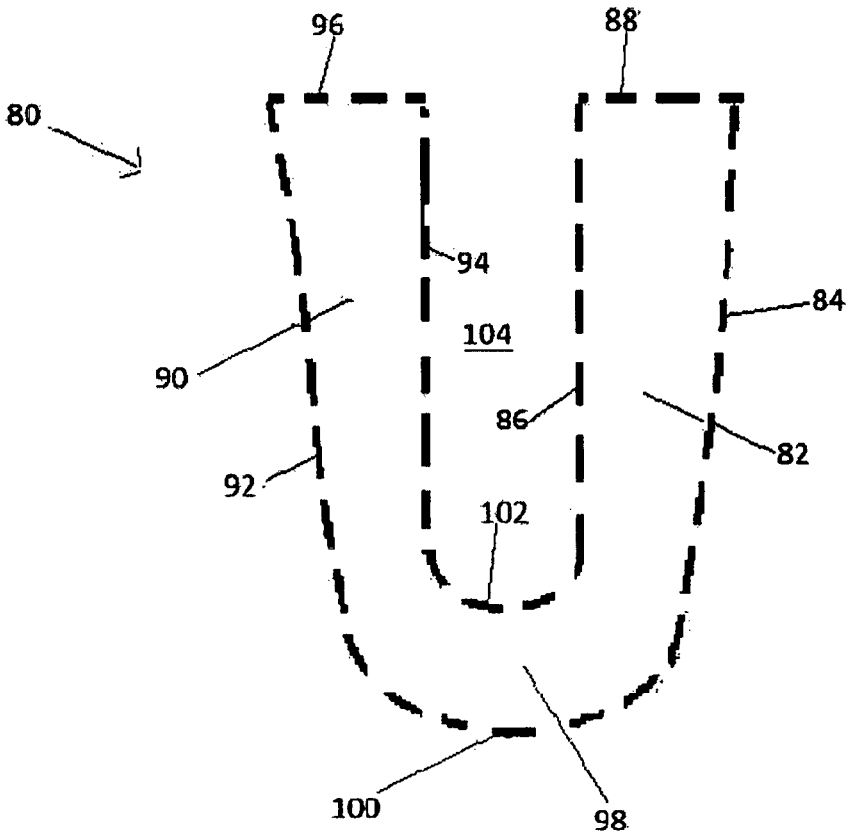
FIG. 3B is an isolated view of the U-shaped insert shown in FIG. 3A.

Gripping portion 12 includes U-shaped insert 80, which is detailed in FIG. 3B. Although U-shaped insert 80 is the preferred shaped insert of the present invention, it is understood that any insert that includes a gap 104 that will be disposed on top of at least a portion of the area of vulnerability of a wearer of the grip assist apparatus 10 is sufficient for the present invention. U-shaped insert 80 is disposed between halves 71, 73 (shown most clearly in FIG. 4) of gripping portion 12. U-shaped insert 80 includes first and second U sides 82, 90, each of which include an outer U side 84, 92; an inner U side 86, 94; and a U top 88, 96. First and second U sides 82, 90 are connected by connecting portion 98, which has a wrist end side 100 near the wrist end 70 of gripping portion 12, and a gap side 102 near gap 104. The wrist end side 100 connects outer U sides 84, 92 of first and second U sides 82, 90. The gap side 102 connects inner U sides 86, 94 of first and second U sides 82, 90. Gap 104 is the space between first and second U sides 82, 90 and connecting portion 98. First and second U outer sides 84, 92 are contoured to follow contour 16 of first and second sides 76, 78 of gripping portion 12. First and second U sides 82, 90 and connecting portion 98 form the U-shaped insert 80 so that when U-shaped insert 80 is disposed between halves 71, 73, gripping portion 12 includes three layers of material at first and second U sides 82, 90 and connecting portion 98. At gap 104, gripping portion 12 only includes two layers of material, namely halves 71, 73.

Gripping portion 12 includes finger end 18, which is the end of gripping portion 12 that covers the user's fingers. End piece 20 is disposed at finger end 18 of the preferred gripping portion 12. End piece 20 is preferably stiff, but flexible, and is preferably rectangular. End piece 20 is disposed within gripping portion 12 by any means commonly used in the art, but preferably by holding it in place between the layers of gripping portion 12 by stitching around end piece 20 and affixing it in place using an adhesive. However, in molded embodiments of the invention, such as is discussed below with reference to FIG. 4, the end piece 20 is molded integral to the gripping portion 12.

When grip assist apparatus 10 is in use, wrist portion 28 securably and releasably wraps around the user's wrist. Wrist portion 28 includes first and second straps 30, 31, which are both preferably rectangular in shape. First strap 30 has free end 34 and attachment end 32, attached to first attachment edge 72 of gripping portion 12. Second strap 31 has free end 35 and attachment end 33, attached to second attachment edge 74 of gripping portion 12. Strap attachment ends 32, 33 may be attached to attachment edges 72, 74 by any means commonly used in the art, but preferably by inserting strap attachment ends 32, 33 between the halves 71, 73 of gripping portion 12 at the attachment edges 72, 74 and affixing strap attachment ends 32, 33 there by stitching and or gluing or other adhesion.

Straps 30, 31 are attached to gripping portion 12 at angle A, which is preferably about 120°. Angle A may be greater or less than 120°, however, depending on the user's hand. Angle A may be customized to best fit the user's hands and to ensure a comfortable fit on either hand. Although straps 30, 31 are not identical in the preferred embodiment, because of the symmetry of gripping portion 12, either strap 30, 31 may be attached to either attachment edge 72, 74. In the preferred embodiment, straps 30, 31 include cushioned pads 38 for the comfort of the user. Cushioned pads 38 are preferably formed of foam rubber covered by a low friction fabric. This is preferred because the fabric covering over the foam rubber allows the straps 30, 31 to slide over the cushioned pads 38 and prevents it from gripping onto the foam rubber.

Straps 30, 31 also include a wrist fastener 36 to fasten wrist portion 28 about the user's wrist. Wrist fastener 36 preferably includes a first section 42 that includes a ring 44 at the strap free end 34 of one of first strap 30. Wrist fastener 36 also preferably includes a second section 46 on second strap 31, which may be inserted through ring 44 to secure wrist portion 28. Second section 46 preferably includes a first length 48 of loop-type fastener and a second length 50 of hook-type fastener so that when second strap 31 on which second section 46 is disposed is inserted through ring 44, first length 48 and second length 50 may be joined and releasably secured.

Figure 4:
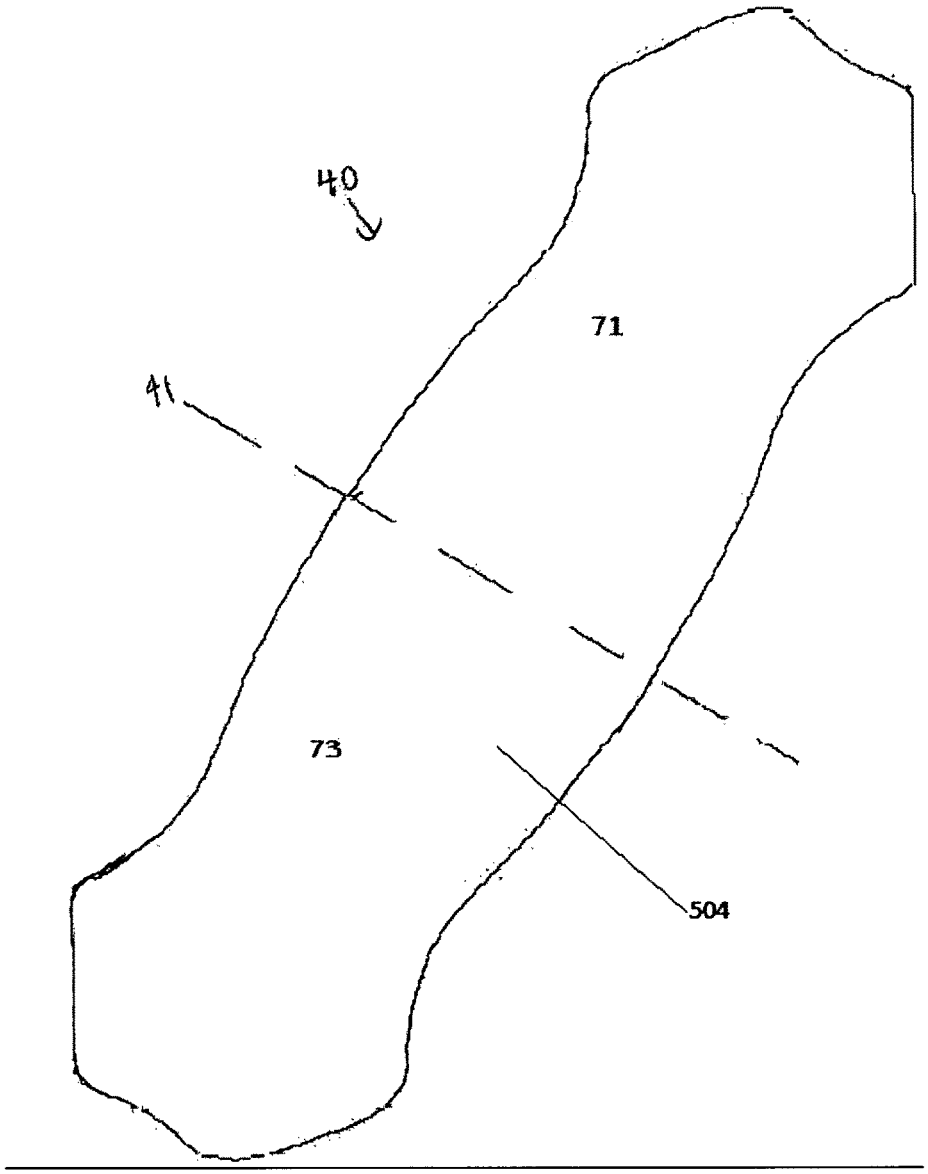
FIG. 4 is a view of the gripping portion unfolded.
Figure 8A:
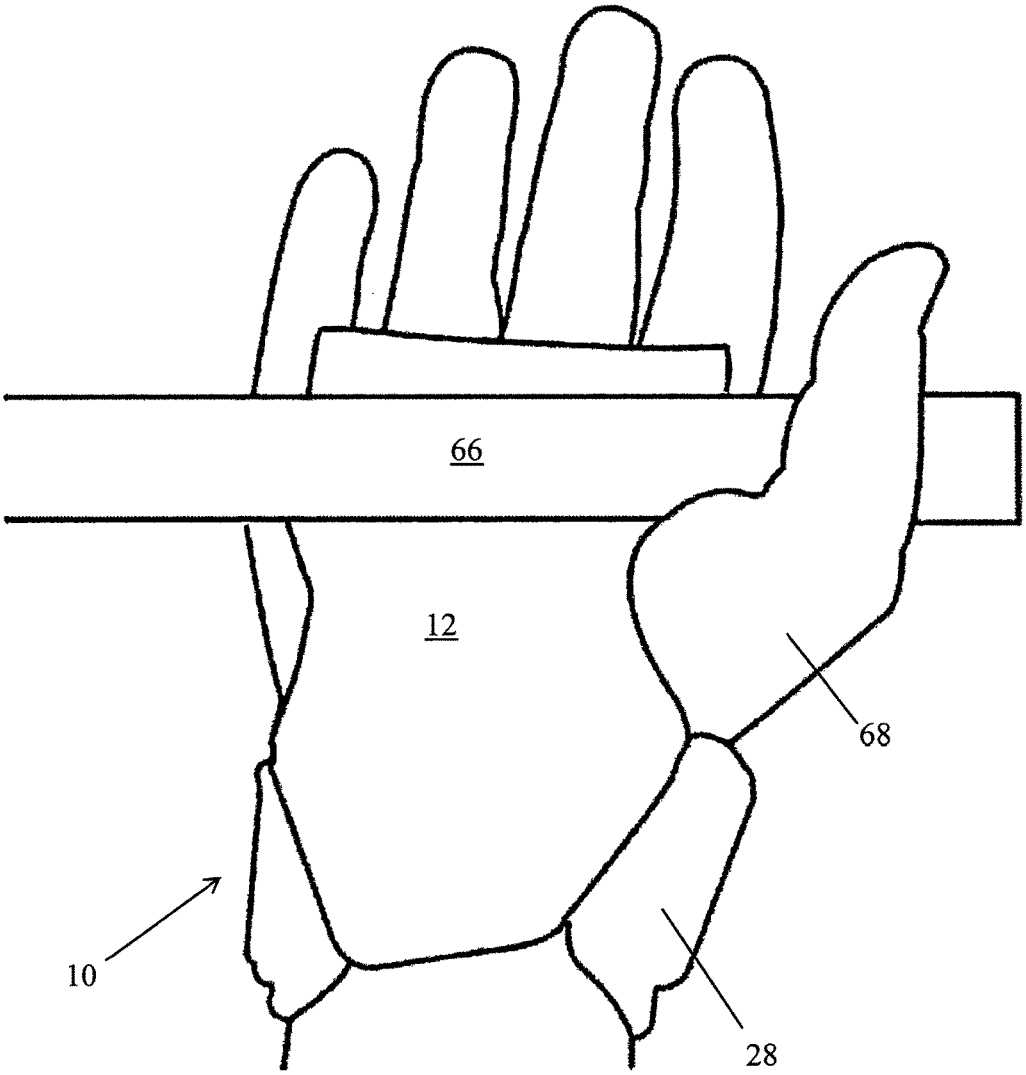
FIG. 8A is a front view of a human hand loosely holding a bar with the grip assist apparatus of the present invention between the bar and the user's hand.
Figure 8B:
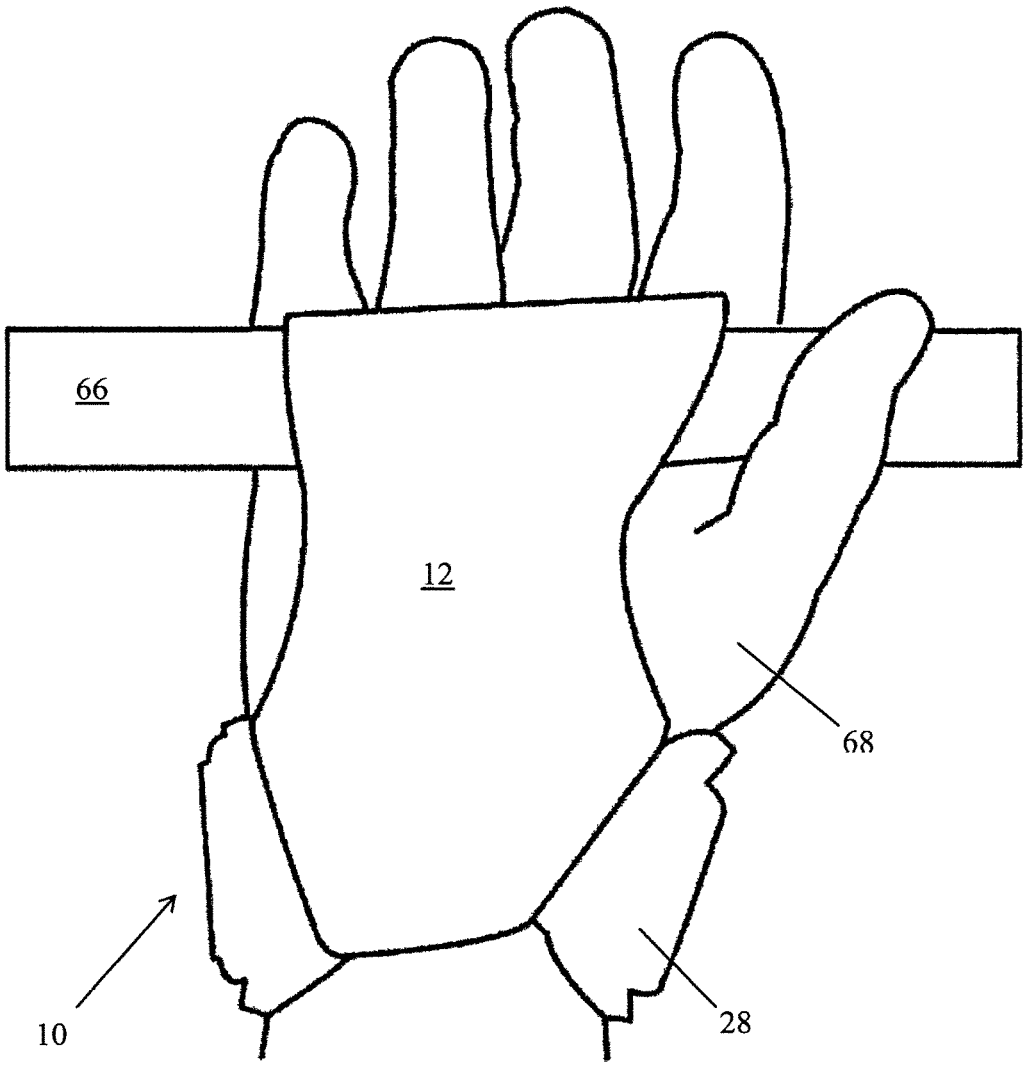
FIG. 8B is a front view of a human hand loosely holding a bar with the bar between the user's hand and the grip assist apparatus of the present invention.

Now referring to FIG. 4, the preferred gripping portion 12 before it is folded is illustrated. Gripping portion 12 is preferably made of a non-slip piece of material 40, such as chlorobutyl rubber, which provides a tacky, sticky surface to allow gripping portion 12 to adhere to the palm of the user's hand instead of sliding around while in use. Material 40 includes a first flat material side 504 and a second flat material side, the second flat material side being understood to be the opposite side of side 504 and therefore facing away from the viewer. The piece of material 40 is non-slip on at least the side that will face out when material 40 is folded. That is to say that the side of the material 40 that will be folded and flush against itself may or may not be non-slip material, but the side that faces out and will be in contact with the user's hand and/or bars 66 (as shown in FIGS. 8A and 8B) is preferably non-slip. Gripping portion 12 is preferably formed by adhering two layers 71, 73 of appropriately sized and shaped non-slip material together, preferably by folding over one piece of non-slip material 40 at first line of symmetry 41, and stitching the two halves 71, 73 together. When first flat material side 504 is folded along first line of symmetry 41, both of layers 71, 73 will face out and second flat material side will face itself and not be visible. In such a scenario, first flat material side 504, facing out, is preferably non-slip. However, in one embodiment, the material is a moldable material, such as urethane, molded rubber or others, that is molded into the shape of at least the non-slip gripping portion 12. When folded along first line of symmetry 41, gripping portion 12 has a rigidity such that it is self-supporting and will remain extended in front of the palm and of the fingers to allow gripping portion 12 to be manipulated by the human hand on which grip assist apparatus 10 is worn. Despite this rigidity, gripping portion 12 is sufficiently flexible to allow itself to be easily wrapped around a lifting bar 66 using only the tip of a finger.

Figure 1:
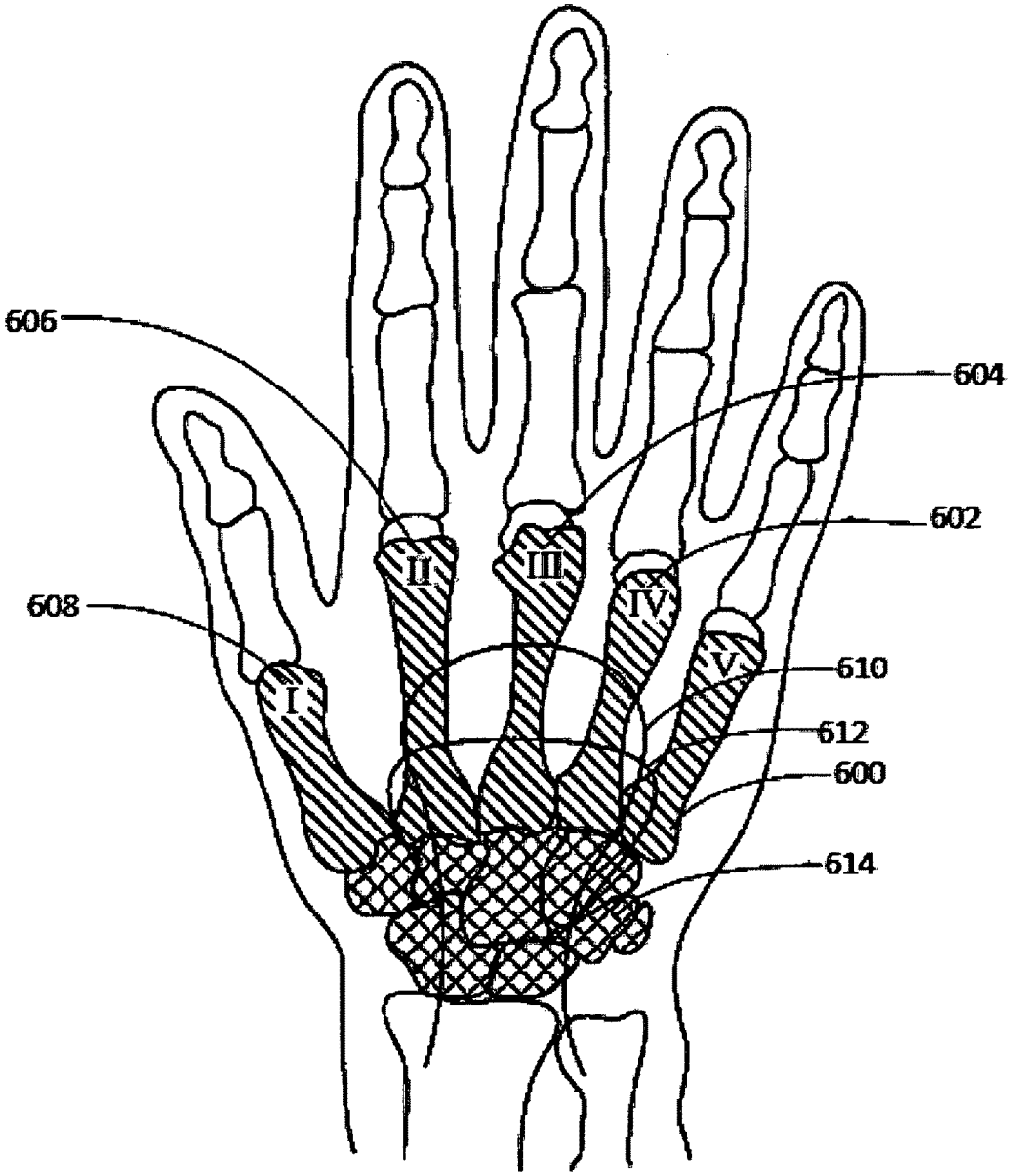
FIG. 1 is a skeletal depiction of a human hand.
Figure 2:
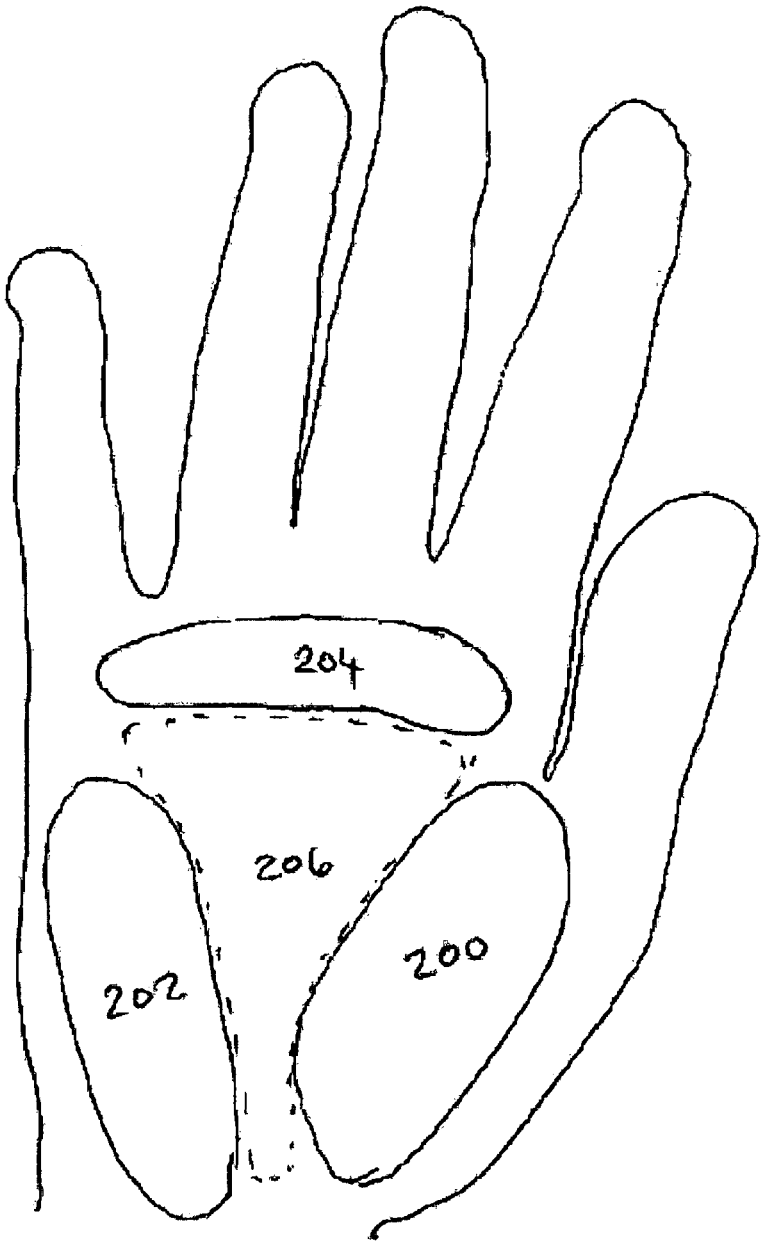
FIG. 2 is a diagram of a human hand depicting the approximate location of the hand's fatty pads.
Figure 5:
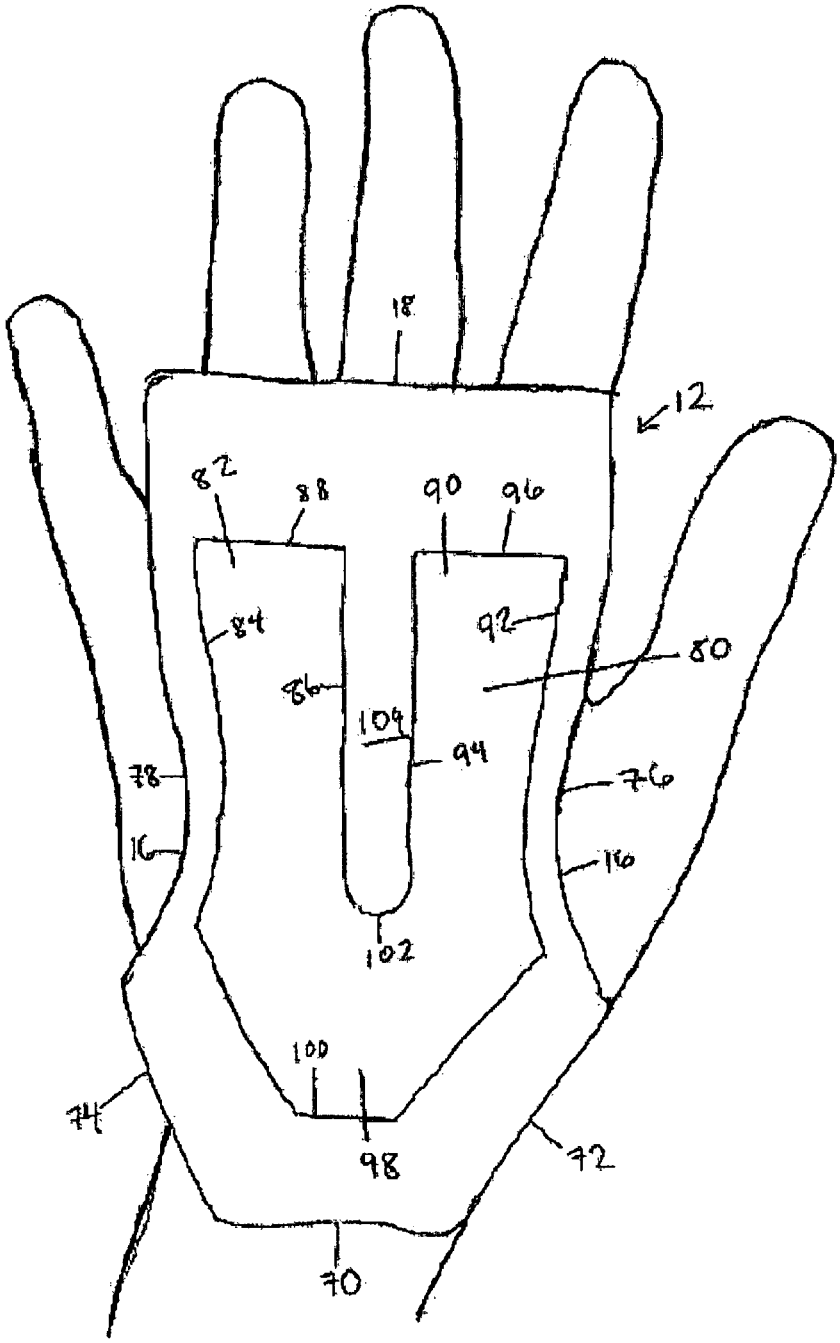
FIG. 5 is a view of the gripping portion superimposed over a hand.

Now referring to FIG. 5, gripping portion 12 is shown superimposed over a hand. For the sake of clarity, wrist portion 28 has not been included in FIG. 5, but is understood to be present as shown in FIG. 3A. Although it is understood that U-shaped insert 80 is disposed between halves 71, 73, it is outlined to indicate its position within gripping portion 12. Comparing FIGS. 2 and 5, it is clear that when gripping portion 12 is placed over a palm as intended, the following will be true: at least a portion of first and second U tops, 88, 96 will be disposed over at least a portion of metacarpal fat pad series 204; at least a portion of first U side 82 is disposed on top of at least a portion of pinky fat pad 202; at least a portion of second U side 90 is disposed on top of at least a portion of thumb fat pad 200; and at least a portion of connecting portion 98 is disposed on top of at least a portion of both pinky fat pad 202 and thumb fat pad 200. Again, it is arbitrary as to whether it is the first or second U side 82, 90 that is disposed on top of the thumb or pinky fat pad 200, 202, as gripping portion 12, including U-shaped insert 80 is symmetrical along second line of symmetry 14. Additionally and importantly, at least a portion of gap 104 is disposed on top of at least a portion of area of vulnerability 206. These placements of the various parts of U-shaped insert 80 ensure that more pressure is placed on the fattier parts of the hand, namely the thumb fat pat 200, pinky fat pad 202, and metacarpal fat pad series 204. Gap 104, surrounded by the area reinforced by U-shaped insert 80, will keep bar 66 from coming into contact with area of vulnerability 206, thus eliminating pressure on this unprotected and uncushioned portion of the hand and preventing injury.

Figure 6:
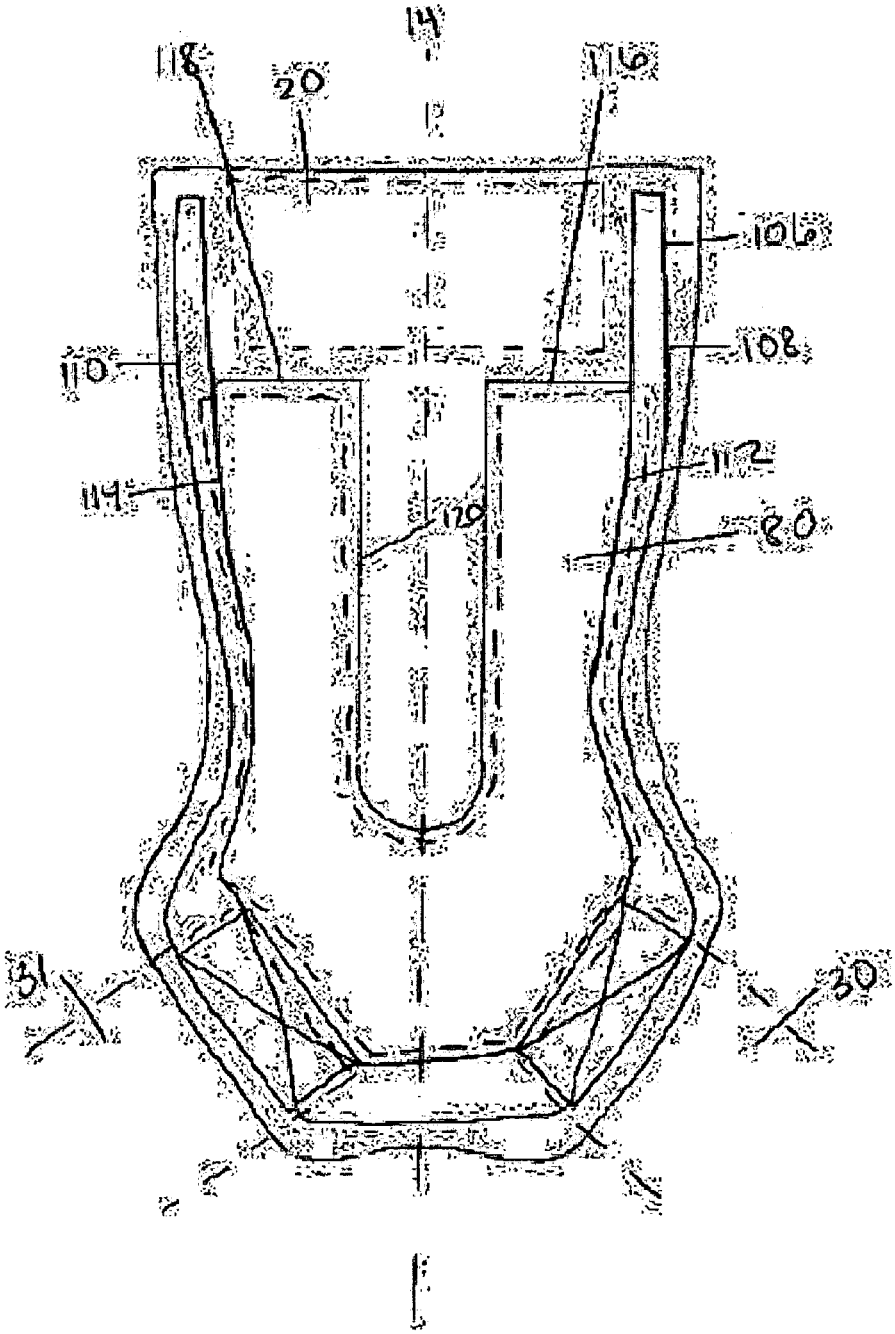
FIG. 6 is a detailed view of the stitching of the gripping portion.

Now referring to FIG. 6, preferred stitching 106 is illustrated. Stitching 106 is the preferred method for securely affixing halves 71, 73 to one another. Other commonly used methods of affixation, such as gluing or other adhesive may also be used. In embodiments where gripping portion 12 is a singled molded piece, no such affixation is necessary. In FIG. 6, except for the perimeter of gripping portion 12, solid lines indicate lines of stitching 106. Dotted lines indicate second line of symmetry 14, the position of end piece 20, the position of U-shaped insert 80, and first and second straps 30, 31. Stitching 106 includes at least first outer section 108, second outer section 110, first inner section 112, second inner section 114, first top section 116, second top section 118, and gap defining section 120. As shown, it is also preferred that first and second outer sections 108, 110 extend downward and meet near wrist end 70 of gripping portion 12 and that additional stitching is included to secure straps 30, 31 to first and second attachment edges 72, 74. First and second outer sections 108, 110 follows contour 16 of first and second sides 76, 78 of gripping portion 12, extending up toward finger end 18 and down toward first and second attachment edges 72, 74 and wrist end 70. First outer section 108 is between first side 76 of gripping portion 12 and first U outer side 84 of U-shaped insert 80. Therefore first outer section 108 is stitching through only first and second halves 71, 73. Second outer section 110 is between second side 78 of gripping portion 12 and second U outer side 92 of U-shaped insert 80. Therefore second outer section 110 is stitching through only first and second halves 71, 73. First inner section 112 is inside of first U outer side 84 of U-shaped insert 80. Therefore first inner section 112 is stitching through first and second halves 71, 73, as well as U-shaped insert 80. Second inner section 114 is inside of second U outer side 92 of U-shaped insert 80. Therefore second inner section 114 is stitching through first and second halves 71, 73, as well as U-shaped insert 80. First and second top sections 116, 118 are stitching just above the tops of first and second U tops 88, 96, respectively, and are therefore stitching through only first and second halves 71, 73. Finally, gap defining section 120 follows first U inner side 86, gap side 102, and second U inner side 94, just within gap 104, so that gap defining section 120 is also stitching through only first and second halves 71, 73. The combination of stitching sections 108-120, particularly with first and second inner sections 112, 114 being through U-shaped insert 80 as well as halves 71, 73, while all other sections are through halves 71, 73 only, holds U-shaped insert 80 in place, securely holds halves 71, 73 against one another, and clearly defines gap 104.

Figure 7:
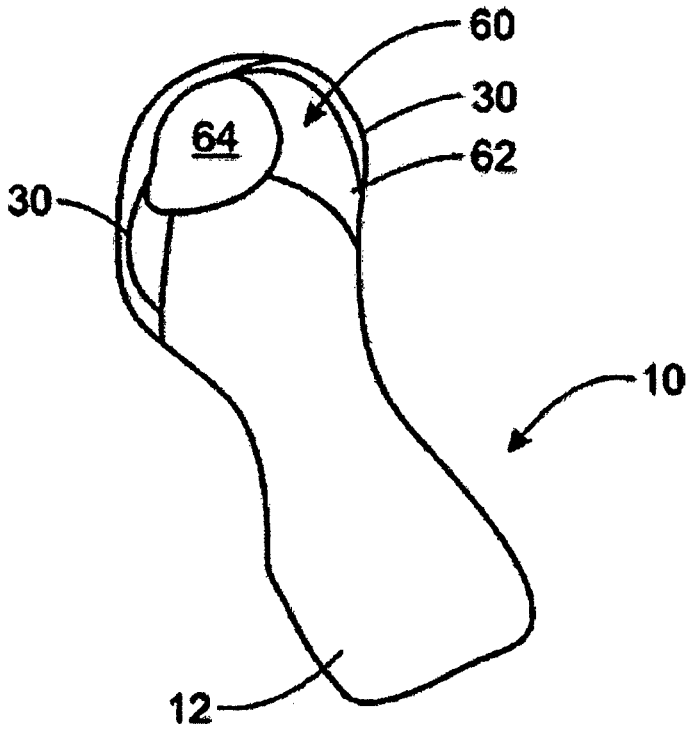
FIG. 7 is an isometric view illustrating the funnel-like opening of the grip assist apparatus of the present invention.

Now referring to FIG. 7, because straps 30, 31 are attached to gripping portion 12 at angle A (shown in FIG. 3A), they form a funnel-like opening 60 when attached to one another. Funnel-like opening 60 serves to grab the user's wrist in order to provide a firm support during strength training. Funnel-like opening 60 has a distal end 62 positioned around the base of the user's hand and a proximal end 64 positioned around the user's wrist. As distal end 62 is larger than proximal end 64, chafing of the base of the hand is prevented. Moreover, the nature of funnel-like opening 60 prevents circulation from being restricted in the user's hand while enabling grip assist apparatus 10 to be firmly attached to the user's wrist. It is noted that positioning the funnel like opening 60 about the base of the hand is preferred when the gripping apparatus is used during pulling exercises. However, when performing pushing exercises, the funnel like opening 60 is preferably positioned about the user's wrist and tightened to provide wrist support.

Now referring to FIGS. 8A and 8B, front views of a human hand loosely holding a bar with the grip assist apparatus 10 are provided. In FIG. 8A, gripping portion 12 is between the bar 66 and the user's hand 68. In FIG. 8B, bar 66 is between gripping portion 12 and the user's hand 68. Thus the user may customize his use of grip assist apparatus 10 to what is most comfortable for him. In particular, the use shown in FIG. 8A may be more comfortable for pushing exercises, such as the bench press or chest press. The use shown in FIG. 8B may be more comfortable for pulling exercises, such as a chinup or the lat pulldown.

Figure 9A:
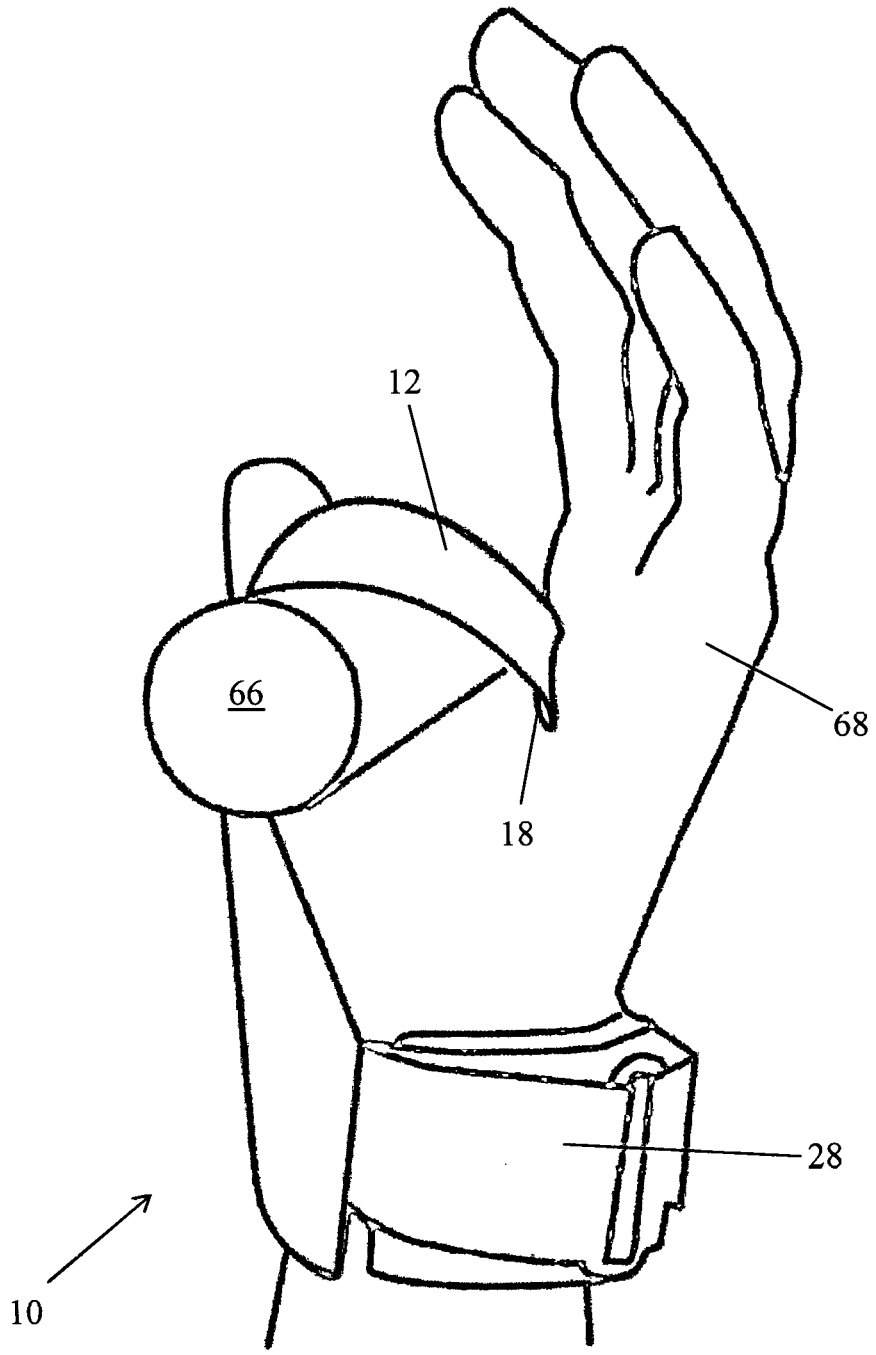
FIG. 9A is a side view of a human hand curling the finger end of the grip assist apparatus of the present invention as shown in FIG. 8B around the bar toward the hand.
Figure 9B:
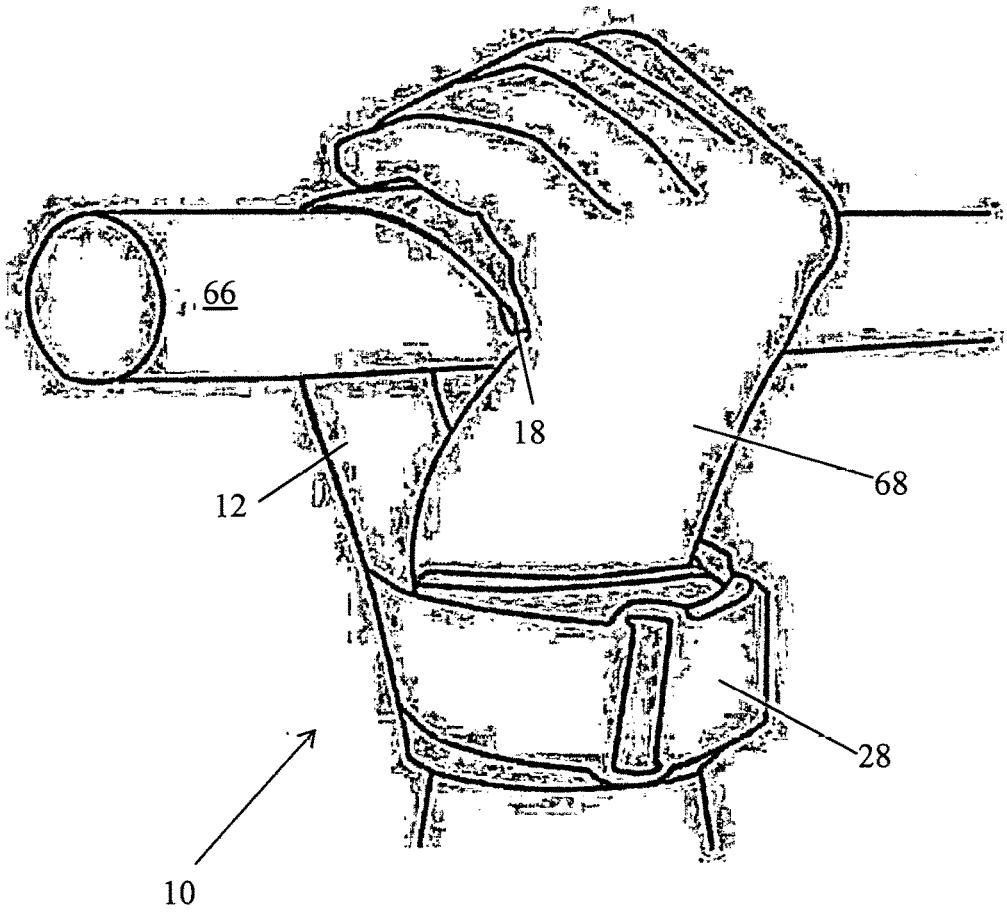
FIG. 9B is a perspective view of a human hand gripping the grip assist apparatus of the present invention as shown in FIG. 9A.

Now referring to FIGS. 9A and 9B, a progression of use from FIG. 8B are provided. In FIG. 9B, a side view of a human hand 68 curling the finger end 18 of gripping portion 12 around the bar 66 toward the hand 68 is provided. In FIG. 9B, a perspective view of a human hand 68 gripping the gripping portion 12 around the bar 66 after the position shown in FIG. 9A is provided. It is understood that a similar progression of use may occur starting with the use shown in FIG. 9A with the gripping portion 12 between bar 66 and hand 68. In other words, the user has the option of gripping bar 66 with gripping portion 12 curling away from hand 68, as suggested by FIG. 8A, or curling toward hand 68, as shown in FIGS. 9A and 9B.

Figure 10:
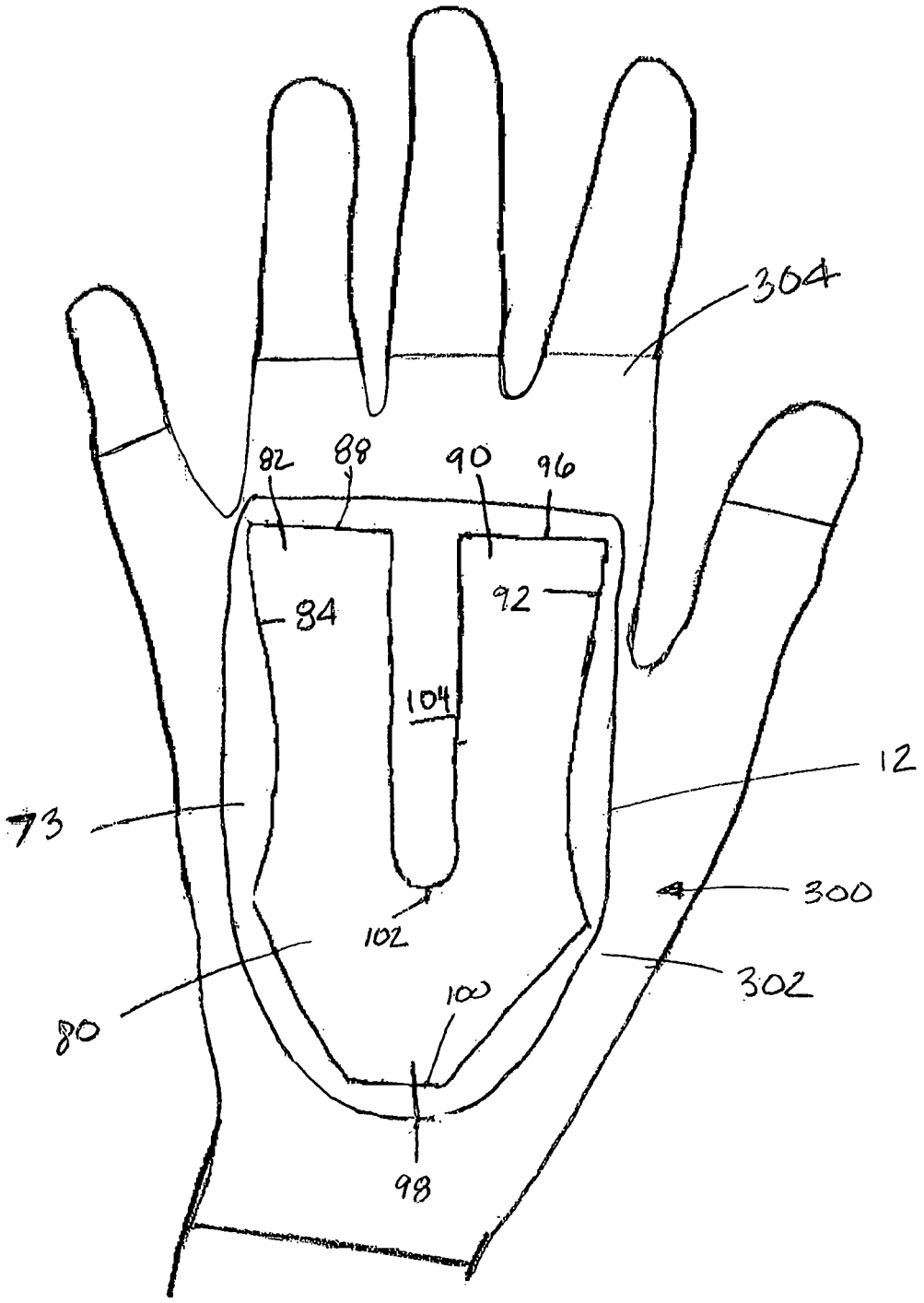
FIG. 10 is front view of an alternative embodiment of the present invention in which the gripping portion is integrated into a weightlifting glove worn on a human hand.

Referring now to FIG. 10, an alternative embodiment of the present invention is shown in which the gripping portion 12 is integrated into a weightlifting glove 300. In such embodiments, the wrist portion of other embodiments is eliminated and is replaced by a glove 300 made of a flexible material that is shaped and dimensioned to cover the user's palm and at least a portion of each finger. In the embodiment of FIG. 10, the glove is a In the embodiment of FIG. 10, the glove material 302 covering the user's palm forms the first layer of the gripping portion 12, the insert 80 is outlined to indicate its position within gripping portion 12 and is positioned upon this layer of glove material 302 and secured in position thereon by an outer layer 43. Comparing FIGS. 2 and 10, it is clear that when the glove 300 is worn, the gripping portion 12 is disposed over a palm such at least a portion of first and second U tops, 88, 96 will be disposed over at least a portion of metacarpal fat pad series 204; at least a portion of first U side 82 is disposed on top of at least a portion of pinky fat pad 202; at least a portion of second U side 90 is disposed on top of at least a portion of thumb fat pad 200; and at least a portion of connecting portion 98 is disposed on top of at least a portion of both pinky fat pad 202 and thumb fat pad 200, and at least a portion of gap 104 is disposed on top of at least a portion of area of vulnerability 206. These placements of the various parts of U-shaped insert 80 ensure that more pressure is placed on the fattier parts of the hand, namely the thumb fat pat 200, pinky fat pad 202, and metacarpal fat pad series 204. Gap 104, surrounded by the area reinforced by U-shaped insert 80, will keep bar 66 from coming into contact with area of vulnerability 206, thus eliminating pressure on this unprotected and uncushioned portion of the hand and preventing injury.

Referring now to FIGS. 11A and 11B, in some embodiments in which the gripping portion 12 is integrated into a weightlifting glove 300, the gripping portion 12 is formed by adhering two layers 71, 73 of appropriately sized and shaped non-slip material together with the insert 80 disposed therebetween. As shown in FIG. 11B, the outer layer 73 is manufactured from a wider sheet of material to allow it to be wrapped over the insert 80 and secured to the inner layer 71. Once so secured, the gripping portion 12 is attached to the glove material 302 in the position shown in FIG. 10. It is noted that FIGS. 10 and 11A show a U-shaped insert 80. However, it is understood that any of the insert shapes disclosed herein may be substituted to achieve similar results.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

What is claimed is:

1. A grip assist apparatus for weight lifting, wherein said grip assist apparatus is dimensioned to cover a palm of a hand of a user from at least one finger to below a wrist joint such that movement of a thumb of the user is not impeded, wherein said hand comprises a thumb fat pad, a pinky fat pad, a metacarpal fat pad series, and an area of vulnerability therebetween, said grip assist apparatus comprising:

a gripping portion formed by affixing first and second halves of flat material of a same shape and size to one another such that said first and second halves are flush, said gripping portion comprising:

a finger end, said finger end comprising a first gripping portion edge;

a wrist end opposite from said finger end, said wrist end comprising first and second wrist end bearings;

a first attachment edge disposed adjacent to said first wrist end bearing of said wrist end;

a second attachment edge disposed adjacent to said second wrist end bearing of said wrist end;

first and second sides extending between said first and second attachment edges and said finger end, wherein each of said first and second sides comprises concave contouring proximate to said first and second attachment edges, such that when said grip assist apparatus is worn over the palm as intended, movement of the thumb of the user is not impeded;

said first side comprises a second gripping portion edge and said second side comprises a third gripping portion edge;

the periphery of the gripping portion being defined by the first gripping portion edge, the second gripping portion edge, the third gripping portion edge, the first attachment edge, the second attachment edge, the first wrist end bearing, and the second wrist end bearing;

a U-shaped insert disposed between said first and second halves comprising a gap, wherein when said U-shaped insert is disposed between said first and second halves:

said gripping portion comprises three layers comprising said first half, said insert, and said second half in all locations of said gripping portion except where said gap of said insert is disposed between said first and second halves;

said gripping portion comprises only two layers comprising said first and second halves where said gap of said insert is disposed between said first and second halves; and when said grip assist apparatus is worn over the palm as intended, said gap is disposed on top of at least a portion of the area of vulnerability proximate to the metacarpal fat pad series and extending from the metacarpal fat pad series towards the pinky fat pad and the thumb fat pad; and wherein said U-shaped insert comprises:

a first U side, comprising:

a first U outer side;

a first U inner side opposite from said first U outer side; and a first U top connecting said first U outer and inner sides;

a second U side, comprising:

a second U outer side;

a second U inner side opposite from said second U outer side; and a second U top connecting said second U outer and inner sides;

a connecting portion connecting said first and second U sides, comprising:

a wrist end side, wherein said wrist end side intersects with said first and second outer U sides of said first and second U sides; and a gap side, wherein said gap side intersects with said first and second inner U sides of said first and second U sides; and said gap formed between said first and second U sides;

wherein, when said grip assist apparatus is worn over the palm as intended:

said wrist end side of said connecting portion is proximate to said wrist end of said gripping portion;

said first U outer side follows said contouring of said first side of said gripping portion;

said second U outer side follows said contouring of said second side of said gripping portion;

at least a portion of said first and second U tops are disposed on top of at least a portion of the metacarpal fat pad series;

at least a portion of one of said first and second U sides is disposed on top of at least a portion of the pinky fat pad;

at least a portion of the other of said first and second U sides is disposed on top of at least a portion of the thumb fat pad; and at least a portion of said connecting portion is disposed on top of at least a portion of the pinky fat pad and the thumb fat pad;

a wrist portion comprising a first strap and a second strap, wherein:

each of said first strap and said second strap comprises an attachment end and a free end;

said attachment end of said first strap extends from said first attachment edge of said gripping portion; and said attachment end of said second strap extends from said second attachment edge of said gripping portion; and a releasable wrist fastener attached to said first and second straps, said wrist fastener being dimensioned and shaped to fasten said first strap to said second strap such that said grip assist apparatus is secured around a wrist of the user.

2. The grip assist apparatus as claimed in claim 1, wherein said flat material from which said gripping portion is formed comprises first and second flat material sides and at least one of said first and second flat material sides is non-slip.

3. The grip assist apparatus as claimed in claim 1, further comprising an end piece disposed between said first and second halves at said finger end of said gripping portion.

4. The grip assist apparatus as claimed in claim 1, further comprising stitching to hold said first and second halves against one another and to hold said U-shaped insert in place between said first and second halves, wherein said stitching comprises at least:

a first outer section between said first side of said gripping portion and said first U outer side of said first U side of said U-shaped insert, wherein said first outer section follows said contour of said first side of said gripping portion and stitches through said first and second halves only;

a second outer section between said second side of said gripping portion and said second U outer side of said second U side of said U-shaped insert, wherein said second outer section follows said contour of said second side of said gripping portion and stitches through said first and second halves only;

a first inner section parallel to said first outer section, wherein at least a portion of said first inner section stitches through said first and second halves and said first U outer side of said first U side of said U-shaped insert;

a second inner section parallel to said second outer section, wherein at least a portion of said second inner section stitches through said first and second halves and said second U outer side of said second U side of said U-shaped insert;

first and second top sections above said first and second U tops of said first and second U sides of said U-shaped insert, wherein said first and second top sections stitch through said first and second halves only; and a gap defining section adjacent to said first and second inner U sides of said first and second U sides and said gap side of said connecting portion of said U-shaped insert, wherein said gap defining section stitches through said first and second halves only.

5. The grip assist apparatus as claimed in claim 1, wherein each of said first and second attachment edges of said gripping portion are angled such that when said first strap and said second strap of said wrist portion are secured about the wrist of the user via said wrist fastener, said first and second straps and said gripping portion form a funnel-shaped enclosure around the wrist and base of the hand, said enclosure having an opening that is larger at a distal end than at a proximal end.

6. The grip assist apparatus as claimed in claim 1, wherein said first strap and said second strap of said wrist portion are each substantially rectangular in shape.

7. The grip assist apparatus as claimed in claim 1, wherein said gripping portion has a rigidity such that said gripping portion is self-supporting and will remain extended in front of the palm and of the fingers to allow said gripping portion to be manipulated by the human hand on which said grip assist apparatus is worn, and wherein said gripping portion is sufficiently flexible to allow said gripping portion to be easily wrapped around a lifting bar using only the tip of said at least one finger of the human hand on which said grip assist apparatus is worn.

8. A grip assist apparatus for pushing and pulling exercises, wherein said grip assist apparatus is dimensioned to cover a palm of a hand of a user from at least one finger to below a wrist joint such that movement of a thumb of the user is not impeded, said grip assist apparatus comprising:

a gripping portion formed by affixing first and second halves of flat material of a same shape and size to one another such that said first and second halves are flush, said gripping portion comprising:

a finger end, wherein said finger end comprises a first gripping portion edge of said gripping portion;

a wrist end opposite from said finger end, said wrist end comprising first and second wrist end bearings;

a first attachment edge disposed adjacent to said first wrist end bearing of said wrist end;

a second attachment edge disposed adjacent to said second wrist end bearing of said wrist end;

first and second sides extending between said first and second attachment edges and said finger end, wherein said first side comprises a second gripping portion edge and said second side comprises a third gripping portion edge;

the periphery of the gripping portion being defined by the first gripping portion edge, the second gripping portion edge, the third gripping portion edge, the first attachment edge, the second attachment edge, the first wrist end bearing, and the second wrist end bearing;

a U-shaped insert disposed between said first and second halves, wherein:

said gripping portion comprises three layers comprising said first half, said U-shaped insert, and said second half where said U-shaped insert is disposed between said first and second halves;

said U-shaped insert comprises:

a first U side;

a second U side; and a connecting portion connecting said first and second U sides, wherein said connecting portion is disposed proximate to said wrist end of said gripping portion and said first and second U sides extend between said connecting portion and said finger end of said gripping portion, such that said first U side follows said first side of said gripping portion and said second U side follows said second side of said gripping portion;

a gap disposed between said first U side, said second U side, and said finger end, wherein said gripping portion comprises only two layers comprising said first and second halves where said gap is disposed;

a wrist portion comprising a first strap and a second strap, wherein:

each of said first strap and said second strap comprises an attachment end and a free end;

said attachment end of said first strap extends from said first attachment edge of said gripping portion; and said attachment end of said second strap extends from said second attachment edge of said gripping portion; and a releasable wrist fastener attached to said first and second straps, said wrist fastener being dimensioned and shaped to fasten said first strap to said second strap such that said grip assist apparatus is secured around a wrist of the user.

9. The grip assist apparatus as claimed in claim 8, wherein each of said first and second sides comprises concave contouring.

10. The grip assist apparatus as claimed in claim 9, wherein said contouring is such that said gripping portion comprises:

a narrowing between said finger end and said wrist end;

a first widening between said narrowing and said finger end; and a second widening between said narrowing and said wrist end.

* * * * *